US007539318B2

(12) United States Patent
Onuma et al.

(10) Patent No.: US 7,539,318 B2
(45) Date of Patent: May 26, 2009

(54) SPEAKER UNIT, METHOD FOR FABRICATING THE SAME, AND SPEAKER APPARATUS

(75) Inventors: Tetsuya Onuma, Tendo (JP); Shinichi Sato, Saitama (JP); Tomoaki Shoji, Saitama (JP); Toshirou Araki, Saitama (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 760 days.

(21) Appl. No.: 11/183,161

(22) Filed: Jul. 18, 2005

(65) Prior Publication Data

US 2006/0018502 A1 Jan. 26, 2006

(30) Foreign Application Priority Data

Jul. 21, 2004 (JP) ..... 2004-212864

(51) Int. Cl.
*H04R 25/00* (2006.01)

(52) U.S. Cl. ..... 381/186; 381/182; 381/412

(58) Field of Classification Search ..... 381/182, 381/186, 340, 344, 386, 400, 401, 402, 412, 381/420, 423, 424, 396; 181/144, 45, 152, 181/159, 177

See application file for complete search history.

(56) References Cited

U.S. PATENT DOCUMENTS 4,472,605 A * 9/1984 Klein ..... 381/186
5,604,815 A * 2/1997 Paddock ..... 381/396
5,701,358 A * 12/1997 Larsen et al. ..... 381/423

FOREIGN PATENT DOCUMENTS

JP 4-8590 1/1992
JP 06-098392 4/1994
JP 07-131893 5/1995

* cited by examiner

*Primary Examiner*—Huyen D Le
(74) *Attorney, Agent, or Firm*—Nixon & Vanderhye P.C.

(57) ABSTRACT

A speaker apparatus is configured such that a speaker unit including a single magnetic circuit system, a plurality of vibration systems and a case is housed inside a speaker box. In the speaker unit, magnetic gaps having a magnetic field of the same magnitude are defined by a magnet holder, a magnet and a yoke in each of the vibration systems. In one vibration system and the other vibration system, voice coils are wound around voice coil bobbins in directions reverse to each other. Consequently, the vibration systems are moved in directions opposite to each other by the same force by applying the same electric signal to the voice coil in each of the vibration systems from an amplifier. Therefore, acoustic waves are radiated in the directions opposite to each other.

4 Claims, 8 Drawing Sheets

SPEAKER UNIT, METHOD FOR FABRICATING THE SAME, AND SPEAKER APPARATUS

BACKGROUND OF THE INVENTION

1. Field of the Invention

The invention relates to a speaker apparatus of a bidirectional radiation type capable of radiating acoustic waves in bi-directions.

2. Description of Related Art

There are known speakers of a bidirectional radiation type capable of radiating acoustic waves in two directions, in which a plurality of magnetic circuits are arranged back to back.

As one of the speakers of such a type, there is known a speaker unit capable of achieving an excellent bidirectivity without any deviation of a phase by bringing completely the same movement in two diaphragms by means of, for example, a repulsion type magnetic circuit such constituted that the same poles of two magnets face to each other via a center plate, as disclosed in, for example, Japanese Patent Application Laid-open (JP-A) No. 7-131893.

Furthermore, there is known an acoustic apparatus capable of achieving a reproduced sound field with a sense of realism by controlling an acoustic output ratio of a forward direct radiation sound to a rearward indirect radiation sound, as disclosed in, for example, Japanese Patent Application Laid-open No. 6-98392. There is also known a low-frequency sound reproduction speaker apparatus for a television receiver, in which two speakers are arranged back to back inside a speaker box, each of the speakers being fixed in such a manner as to orient in both of right and left directions, as disclosed in, for example, Japanese Utility Model Application Laid-open (JP-U) No. 4-8590.

However, since the plurality of magnetic circuits need be provided in the above-described speakers, the number of component parts is increased by the number of magnetic circuits, thereby raising a problem of an increase in cost. In addition, in the above-described speakers, vibration is generated in the magnetic circuit by a reaction of the vibration generated in the diaphragm, and further the vibration is transmitted to a case housing the magnetic circuits and the diaphragms, thereby raising a problem of radiation of an abnormal noise such as a chattering noise from the case or the like.

SUMMARY OF THE INVENTION

The invention has been accomplished to solve the above-described problems experienced in the prior art. Therefore, an object of the invention is to provide a speaker apparatus of a bidirectional radiation type, a method for fabricating the same and the like, in which it is possible to prevent any generation of an abnormal noise and reduce the number of component parts.

According to one aspect of the present invention, there is provided a speaker unit including: a magnetic circuit having a disk-like magnet whose both surfaces are magnetized; a pair of magnetic gaps formed at positions near both surfaces of the disk-like magnet inside the magnetic circuit; a pair of voice coils arranged in a manner corresponding to the pair of magnetic gaps, respectively; and a pair of diaphragms which are driven by the pair of voice coils, respectively, and which radiate acoustic waves in directions opposite to each other.

The above-described speaker unit is provided with the magnetic circuit having the disk-like magnet whose both surfaces are magnetized. In a preferred example, the magnetic circuit may include a pair of plates fixed to both surfaces of the disk-like magnet, respectively, and a cylindrical yoke arranged, with a spacing equivalent to the magnetic gap, apart from a peripheral surface of each of the disk-like magnet and the pair of plates. The pair of magnetic gaps are formed at the positions near both surfaces of the disk-like magnet inside of the magnetic circuit. Moreover, the pair of voice coils are arranged at the positions corresponding to the pair of magnetic gaps inside the pair of a magnetic gaps.

With the above-described configuration, the speaker unit can radiate the acoustic waves via the pair of diaphragms in the directions opposite to each other, respectively, by applying an electric signal to the pair of voice coils from an amplifier. Therefore, in the case that the speaker unit housed in, for example, the speaker box is set near the center of a vehicular cabin, the acoustic waves can be bidirectionally radiated to both of front seats and rear seats. In other words, in the above-described speaker unit, the single magnetic circuit provided with the two magnetic gaps can constitute a speaker for radiating the acoustic waves in the directions opposite to each other. As a consequence, the number of component parts can be reduced since only one magnetic circuit is provided. Thus, the speaker unit can be reduced in size, weight and cost.

Additionally, in the above-described speaker unit, the diaphragms can be driven in the directions opposite to each other via the pair of voice coils, respectively. In this manner, since force (namely, vibrations) generated by the reaction in association with the driving of one of the diaphragms and force (namely, vibrations) generated by the reaction in association with the driving of the other diaphragm are cancelled by each other in the magnetic circuit, unnecessary vibrations in the magnetic circuit due to the reaction can be suppressed. Consequently, in the case that the above-described speaker unit housed inside of, for example, a case and the speaker box is set inside of the vehicular cabin, an abnormal noise such as a chattering noise can be suppressed from being radiated to the vehicular cabin from the speaker box or the like. Thus, it is possible to achieve sound reproduction with a high quality.

In one mode of the above speaker unit, the magnetic circuit may include a magnet holder to be fixed to the peripheral surface of the disk-like magnet, and the cylindrical yoke may be fixed to the disk-like magnet via the magnet holder.

In this mode, the magnetic circuit may include the magnet holder to be fixed to the peripheral surface of the disk-like magnet. In a preferred example, the magnet holder may be made of a non-magnetic material and may be formed into an annular shape. Therefore, the yoke can be fixed to the disk-like magnet via the magnet holder. In an embodiment, if the magnet holder is fixed at substantially the center position at the peripheral surface of the magnet, functions and effects, principally described below, are produced.

First, the pair of magnetic gaps having magnetic fields of substantially the same magnitude can be formed on both sides of the magnet holder. In addition, even if an electric signal of a large amplitude is applied to the pair of voice coils due to some factor and hence the pair of voice coils are largely moved in directions in which they collide with each other, the magnet holder serves as a stopper to avoid any collision of the voice coils against each other. As a consequence, it is possible to prevent any breakage of the voice coil or the like.

In another mode of the above-described speaker unit, the pair of voice coils may have the same effective line length and may be wound in directions relatively reverse to each other, and the speaker unit may further include a signal supplying circuit for supplying an equal electric signal to the pair of voice coils.

In this mode, the pair of voice coils have the same effective line length, and are wound in the directions reverse to each other. Since magnetic flux densities of the pair of magnetic gaps are substantially equal to each other, the pair of diaphragms are driven by force of the same magnitude in the directions opposite to each other. As a consequence, it is possible to prevent any vibration from being generated in the magnetic circuit.

A speaker apparatus can be configured by housing the above-described speaker unit inside the speaker box. The speaker apparatus can be preferably used as a speaker apparatus to be mounted on a vehicle.

According to another aspect of the present invention, there is provided a method for fabricating a speaker unit including a process of fabricating a magnetic circuit, the process including the steps of: attaching an annular magnet holder to a disk-like magnet; fitting the disk-like magnet and the magnet holder into a cylindrical yoke; and attaching disk-like plates to both surfaces of the disk-like magnet.

In the above-described method for fabricating a speaker unit, a magnet assembly as a semi-product can be fabricated by attaching the annular magnet holder to the disk-like magnet. The magnet assembly is fitted into the cylindrical yoke, and further the disk-like plates are attached to both surfaces of the disk-like magnet, respectively, thus fabricating the magnetic circuit. In the above-described method for fabricating a speaker unit, it is possible to reduce an assembling cost since only one magnetic circuit is fabricated.

The above-described method may further include the steps of: symmetrically fixing a pair of diaphragm units onto both sides of the magnetic circuit; and housing the magnetic circuit and the pair of diaphragm units inside of a case. As a consequence, it is possible to fabricate the speaker unit which is housed inside the case and can radiate the acoustic waves in the directions opposite to each other via the pair of diaphragm units, respectively.

The nature, utility, and further features of this invention will be more clearly apparent from the following detailed description with respect to preferred embodiment of the invention when read in conjunction with the accompanying drawings briefly described below.

DETAILED DESCRIPTION OF THE PREFERRED EMBODIMENTS

The preferred embodiments of the present invention will now be described below with reference to the attached drawings. According to the invention, there is provided a speaker apparatus of a bidirectional radiation type for radiating acoustic waves in directions opposite to each other by means of a single magnetic circuit system provided with two magnetic gaps and a plurality of vibration systems. As a consequence, it is possible to prevent any generation of an abnormal noise and reduce the number of component parts.

[Configuration of Speaker Apparatus]

Figure 1:
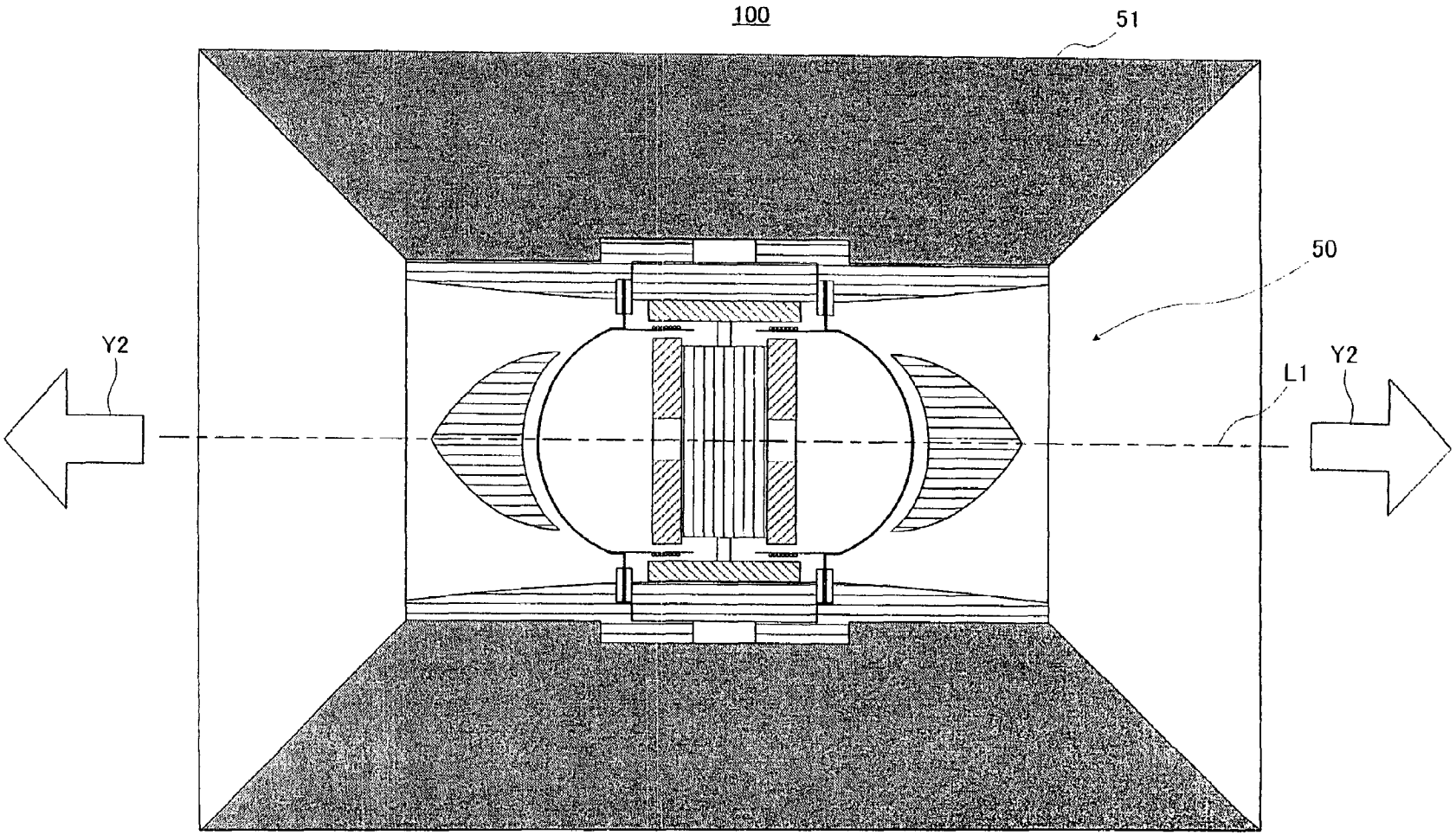
FIG. 1 is a cross-sectional view schematically showing the configuration of a speaker apparatus in an embodiment according to the invention.
Figure 2:
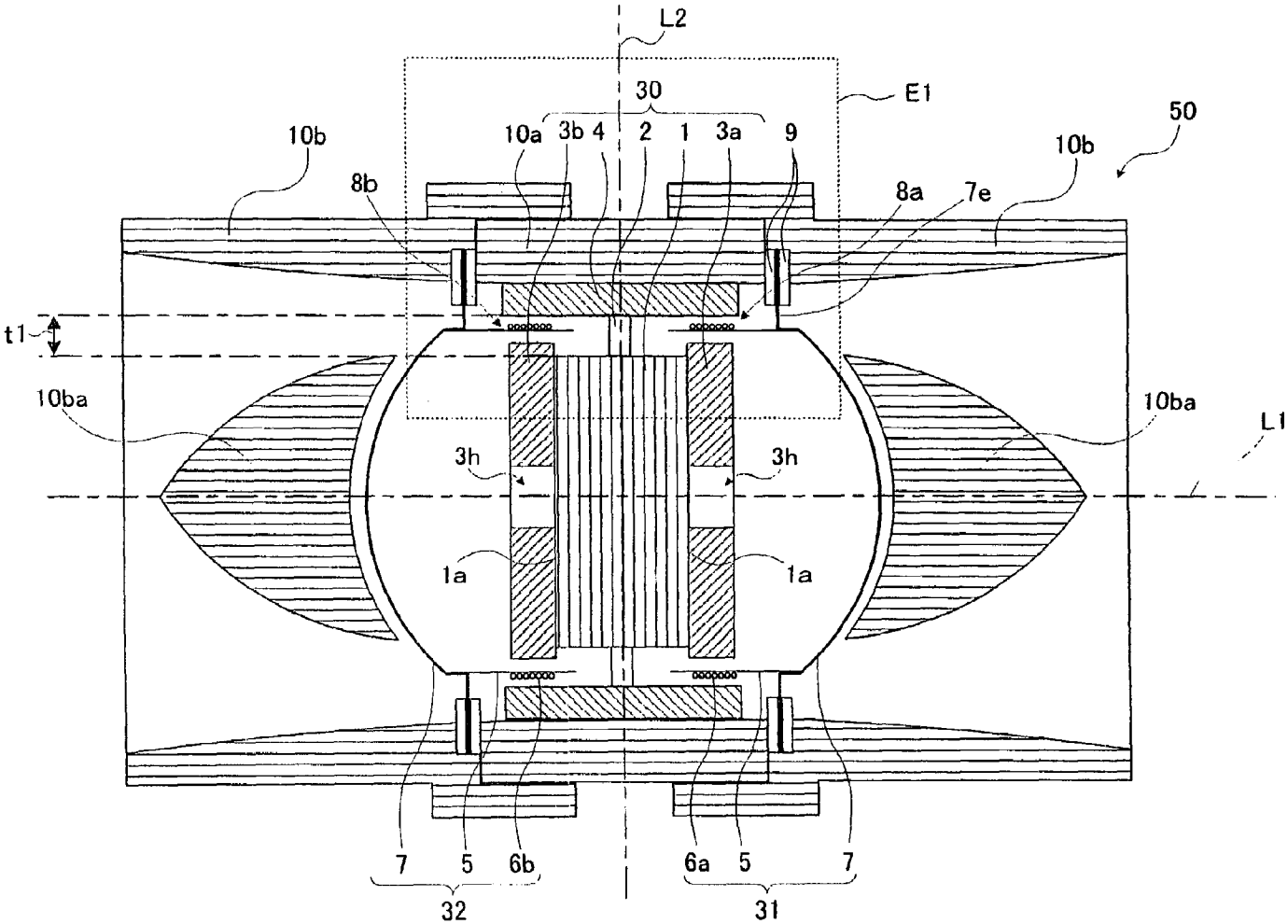
FIG. 2 is an enlarged cross-sectional view showing the configuration of a speaker unit in the embodiment.

FIG. 1 is a cross-sectional view showing a speaker apparatus 100, cut on a plane Including its center axis L1. FIG. 2 is an enlarged cross-sectional view showing only a speaker unit 50 shown in FIG. 1. Hereinafter, the configuration or the like of the speaker apparatus 100 in an embodiment will be explained with reference to FIGS. 1 and 2.

The speaker apparatus 100 is a speaker of a bidirectional radiation type capable of bidirectionally radiating acoustic waves. In addition, the speaker apparatus 100 is not only a speaker of a so-called horn type but also a speaker for reproducing a high frequency sound. As shown in FIG. 1, the speaker apparatus 100 is configured such that the speaker unit 50 is housed inside a speaker box 51. Furthermore, the speaker apparatus 100 is used suitably for a speaker apparatus mounted on a vehicle. In the case that the speaker apparatus 100 is mounted on a vehicle, the speaker apparatus 100 is set in, for example, a space between front seats and rear seats in a vehicle cabin so that sound are radiated in both front and rear direction. Thus, a high frequency sound can be reproduced at both of the front seat and the rear seat.

The speaker unit 50 includes: a magnetic circuit system 30 having a magnet 1, a pair of plates 3*a* and 3*b*, a yoke 4 and a magnet holder 2; a vibration system 31 having a voice coil bobbin 5, a voice coil 6*a* and a diaphragm 7; another vibration system 32 having another voice coil bobbin 5, a voice coil 6*b* and another diaphragm 7; and a case 10.

First, constituent elements in the magnetic circuit system 30 will be explained.

The magnet 1 is arranged substantially at the center position of the speaker unit 50. The magnet 1 is formed into substantially a disk shape, and it is magnetized near its right and left surfaces 1*a*.

The magnet holder 2 is made of a non-magnetic material such as a resin. The magnet holder 2 is formed into substantially an annular shape, having substantially the same inner diameter as an outer diameter of the magnet 1. The magnet holder 2 is fixed onto an outer peripheral wall of the magnet 1 substantially at the center position in a thickness direction of the magnet 1. Consequently, a predetermined spacing t1 is defined between an outer peripheral wall of the magnet holder 2 and the outer peripheral wall of the magnet 1. Incidentally, other functions of the magnet holder 2 will be explained later.

Each of the plates 3*a* and 3*b* is formed into substantially an annular shape, and has an opening 3*h* at its center position. The plates 3*a* and 3*b* are disposed at positions to cover the right and left surfaces 1*a* of the magnet 1, respectively.

The yoke 4 is formed into substantially a cylindrical shape, having substantially the same inner diameter as an outer diameter of the magnet holder 2. The yoke 4 is fixed onto the outer peripheral wall of the magnet holder 2, and secured to the magnet 1 via the magnet holder 2. That is, the yoke 4 houses the magnet 1 therein via the magnet holder 2. As a result, an inner peripheral wall of the yoke 4 faces to the outer peripheral wall of each of the magnet 1 and the plurality of plates 3. By the spacing t1 defined between the magnet holder 2 and the magnet 1, a magnetic gap 8*a* having a spacing slightly narrower than the spacing t1 is defined between an inner peripheral wall of the yoke 4 and an outer peripheral wall of one plate 3*a*. Further, a magnetic gap 8*b* slightly narrower than the spacing t1 is defined between the inner peripheral wall of the yoke 4 and an outer peripheral wall of the other plate 3*b*. Since the two magnetic gaps 8*a* and 8*b* have substantially the same spacing, a magnetic field (namely, a magnetic flux density) having substantially the same magnitude is formed at each of the magnetic gaps 8*a* and 8*b*.

In the magnetic circuit system 30, a magnetic circuit is constituted of the single magnet 1, the pair of plates 3*a* and 3*b*, the single yoke 4 and the magnet holder 2, and the magnetic flux of the magnet 1 is concentrated on each of the magnetic gaps 8*a* and 8*b*.

Next, constituent elements in the vibration system 31 will be explained. The vibration system 31 includes the voice coil bobbin 5, the voice coil 6*a* and the diaphragm 7.

The voice coil bobbin 5 is formed into substantially a cylindrical shape. An inner peripheral wall of the voice coil bobbin 5 faces the outer peripheral wall of the annular plate 3*a* with a given spacing. An outer peripheral wall of the voice coil bobbin 5 faces the inner peripheral wall of the yoke 4 with a given spacing.

The voice coil 6*a* is wound around the outer peripheral wall of the voice coil bobbin 5. The voice coil 6*a* has a pair of plus and minus lead wires, not shown. The plus lead wire is an input wiring for an L (or an R) channel signal, and the minus lead wire is an input wiring for a ground (abbreviated as "a GND"). Each of the lead wires is electrically connected to a connecting terminal, not shown. An electric signal of one channel is input into the voice coil 6*a* from an amplifier, not shown, via the connecting terminal.

The diaphragm 7 has a domed shape suitable for high frequency sound reproduction, and is formed integrally with or independently of an edge 7*e*. The diaphragm 7 may be formed of various kinds of materials such as paper, high polymer and metal according to various usages. An outer circumferential edge of the diaphragm 7, that is, an outer circumference of the edge 7*e* is held by a plurality of fixing members 9 or the like.

The vibration system 32 includes the voice coil bobbin 5, the voice coil 6*b* and the diaphragm 7. The configuration of the vibration system 32 is substantially identical to that of the vibration system 31. However, the voice coils 6 are wound around the voice coil bobbins 5 in directions reverse to each other, in comparison of the vibration system 32 with the vibration system 31. The effective line lengths of the voice coil 6*a* and the voice coil 6*b* are equal to each other. Moreover, the same electric signal as that input into the voice coil 6*a* is input into the voice coil 6*b*.

The vibration system 32 and the vibration system 31 are arranged at positions perpendicular to the center axis L1 of the speaker unit 50, as viewed in cross section, and symmetric to each other with respect to a straight line L2 which passes through the center of the magnet 1 and which is perpendicular to the center axis L1. In other words, a sound radiation direction of the diaphragm 7 in the vibration system 31 is opposite to a sound radiation direction of the diaphragm 7 in the vibration system 32.

The case 10 is formed into substantially a cylindrical shape in an assembled state, and has a first member 10*a* and a plurality of second members 10*b*. The first member 10*a* is formed into substantially a cylindrical shape. The first member 10*a* houses the magnetic circuit system 30 therein, and holds it. Each of the second members 10*b* is formed into substantially a cylindrical shape, and has an equalizer 10*ba*. The equalizer 10*ba* has the function of expanding, in a specific direction, an acoustic wave generated by each of the diaphragms 7. Each of the second members 10*b* supports the vibration systems 31 and 32 together with the first member 10*a* in a state fixed to the first member 10*a*.

Figure 3A:
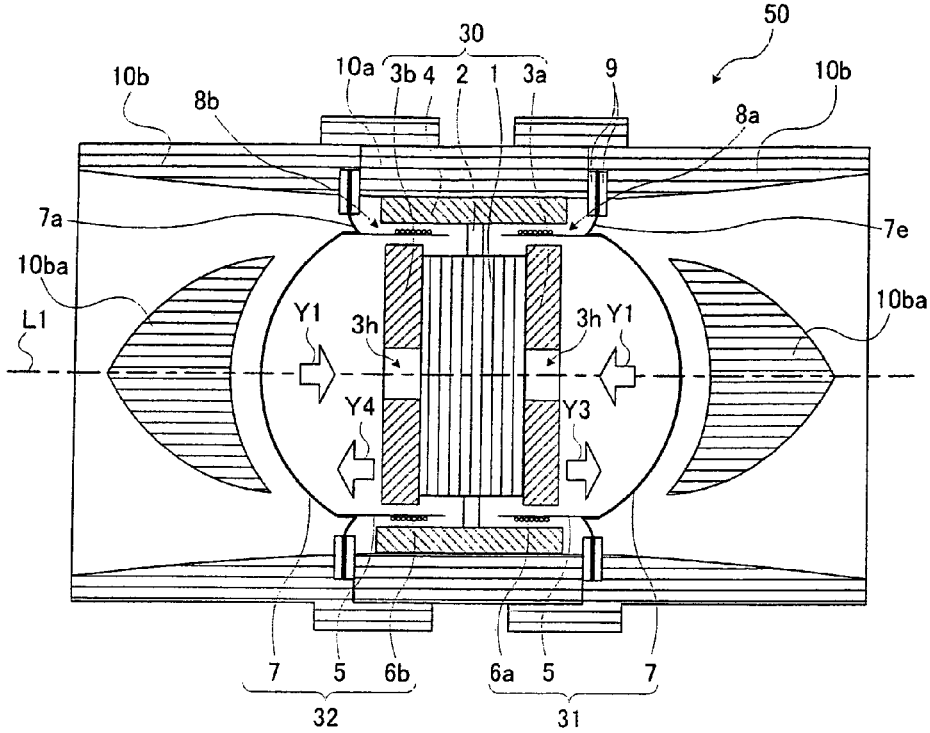
FIGS. 3A and 3B are cross-sectional views explaining the principle or the like of acoustic reproduction by the speaker unit in the embodiment.

Subsequently, the principle of sound radiation by the speaker unit 50 will be explained below with reference to FIGS. 3A and 3B.

In the speaker unit 50 having the above-described configuration, when the same electric signal (having the same phase) is supplied to each of the voice coils 6*a* and 6*b* via the connecting terminal from the amplifier, driving force is generated at each of the voice coils 6*a* and 6*b* inside each of the magnetic gaps 8*a* and 8*b*, thereby vibrating each of the diaphragms 7 in the direction of the center axis L1 of the speaker unit 50. At this time, the diaphragm 7 in the vibration system 31 and the diaphragm 7 in the vibration system 32 are vibrated in directions opposite to each other, as indicated by arrows Y1 in FIG. 3A and arrows Y2 in FIG. 3B. This is because the voice coils 6 are wound around the voice coil bobbins 5 in the directions reverse to each other in the vibration system 31 and the vibration system 32, as described above. Additionally, since the magnetic fields having substantially the same magnitude are formed at the two magnetic gaps 8*a* and 8*b*, the vibration systems 31 and 32 are vibrated by substantially the same force. In this manner, the speaker unit 50 can radiate the acoustic waves in the two directions indicated by arrows Y2 in FIG. 1.

The above-described speaker unit 50 can radiate the acoustic waves in the directions opposite to each other by the single magnetic circuit system 30 provided with the two magnetic gaps 8*a* and 8*b* and the two vibration systems 31 and 32. That is, according to the invention, the speaker of the bidirectional radiation type can be configured without providing a plurality of magnetic circuits. Consequently, it is possible to reduce the number of component parts because only one magnetic circuit is provided. Thus, the speaker unit 50 can be reduced in size, weight and cost.

Furthermore, the speaker unit 50 can suppress (or cancel) the vibrations in the magnetic circuit system 30 caused by the effect of the reactions to the vibrations of the vibration systems 31 and 32. Here, such a function will be explained below with reference to FIGS. 3A and 3B. First, in the speaker unit 50 in a state shown in FIG. 3A, the vibration systems 31 and 32 are moved at the same timing toward the magnetic circuit system 30, that is, in the directions indicated by the arrows Y1. Therefore, the magnetic circuit system 30 is moved in a direction indicated by an arrow Y3 opposite to the direction indicated by the arrow Y1 by the effect of the reaction of the vibration system 31 to the movement of the vibration system 31. In the meantime, the magnetic circuit system 30 is moved in a direction indicated by an arrow Y4 opposite to the direction indicated by the arrow Y1 by the effect of the reaction of the vibration system 32 to the movement of the vibration system 32. As a consequence, the force in the direction indicated by the arrow Y3 generated in the magnetic circuit system 30 by the vibration system 31 is canceled by the force in the direction indicated by the arrow Y4 generated in the magnetic circuit system 30 by the vibration system 32. Thus, it is possible to suppress (or cancel) the vibrations generated in the magnetic circuit system 30.

Figure 3B:
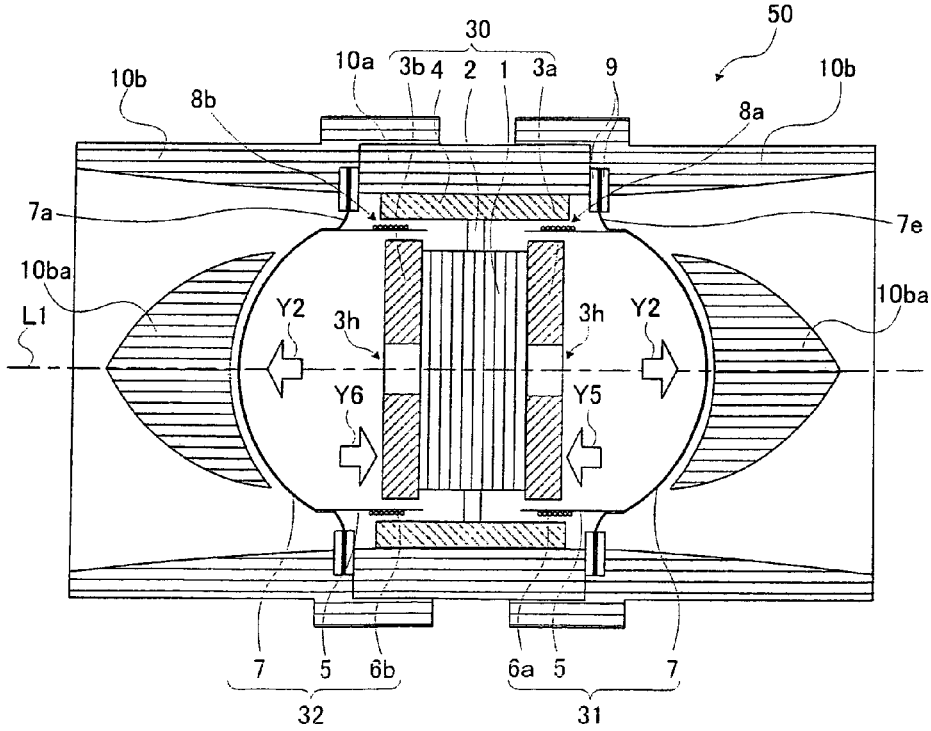

On the other hand, in the speaker unit 50 in a state shown in FIG. 3B, the vibration systems 31 and 32 are moved at the same timing away from the magnetic circuit system 30, that is, in the directions indicated by the arrows Y2. Also in this case, the force in a direction indicated by an arrow Y5 generated in the magnetic circuit system 30 by the vibration system 31 is canceled by the force in a direction indicated by an arrow Y6 generated in the magnetic circuit system 30 by the vibration system 32. Thus, in the same manner, it is possible to suppress (or cancel) the vibrations generated in the magnetic circuit system 30.

As a consequence, in the speaker unit 50, even if the vibration systems 31 and 32 are vibrating, the vibrations generated by the reaction can be canceled, thereby preventing the transmission of the vibrations to the case 10 or the speaker box 51 via the magnetic circuit system 30. Thus, even if the speaker box 51 housing therein the speaker unit 50 according to the invention is set inside the vehicular cabin, for example, it is possible to prevent any radiation of an abnormal noise such as a chattering noise from the case 10 or the speaker box 51 into the vehicular cabin, so as to achieve a sound of a high quality.

Figure 4:
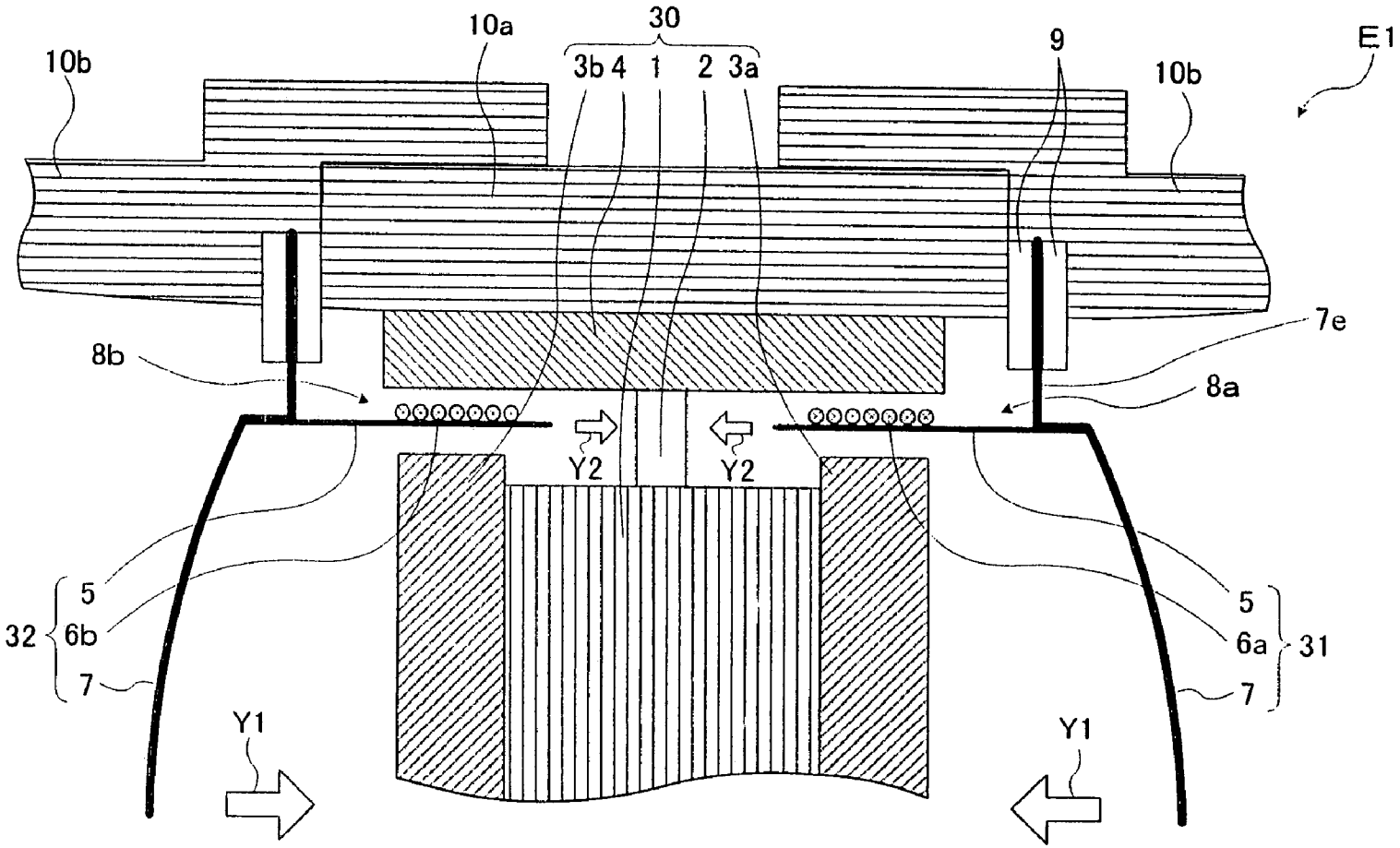
FIG. 4 is a view explaining a function or the like of a magnet holder in the embodiment.

Particularly, since the magnet holder 2 is fixed at substantially the center position of the magnet 1 in the speaker unit 50, the vibration systems 31 and 32 can be prevented from being broken even if the vibration systems 31 and 32 are largely moved by some factor. This point will be explained with reference to FIG. 4. FIG. 4 is a partly enlarged cross-sectional view showing a region E1 surrounded by a broken line in FIG. 2. Here, assuming that the vibration systems 31 and 32 are largely moved in the direction indicated by the arrows Y1 by inputting the electric signal of an amplitude greater than usual into each of the voice coils 6*a* and 6*b* by some factor, the circumferential bottom end of each of the voice coil bobbins 5 in the vibration systems 31 and 32 is largely moved toward the magnet holder 2, as indicated by the arrows Y2. If no magnet holder 2 is provided in the above-described state, the circumferential bottom end of the voice coil bobbin 5 in the vibration system 31 and the circumferential bottom end of the voice coil bobbin 5 in the vibration system 32 collide with each other, thereby raising a danger of breakage of the vibration systems 31 and 32.

However, since the speaker unit 50 is configured such that the magnet holder 2 is fixed at substantially the center position of the magnet 1, as described above, the magnet holder 2 also functions as a stopper even if the vibration systems 31 and 32 are largely moved and prevents any collision of the voice coil bobbin 5 in the vibration system 31 with the voice coil bobbin 5 in the vibration system 32. Thus, it is possible to securely prevent any breakage or the like of the vibration systems 31 and 32 in the speaker unit 50 even if the vibration systems 31 and 32 are largely moved by some factor.

[Modifications]

Although the magnetic circuit system 30 is constituted by using the plate 3 having the opening 3h in the above-described embodiment, the configuration of the magnetic circuit system 30 is not limited to this. The magnetic circuit system 30 may be constituted by using a plate formed into a disk shape.

In addition, in the above-described embodiment, the voice coils 6 are wound around the voice coil bobbins 5 in the vibration systems 31 and 32 in the directions reverse to each other, and the diaphragms 7 in the vibration systems 31 and 32 are vibrated in the directions opposite to each other, thereby suppressing (or canceling) the vibrations generated in the magnetic circuit system 30. However, the configuration of each of the vibration systems 31 and 32 is not limited to this. The same effect as that produced by the above-described configuration may be produced by winding the voice coils 6 around the voice coil bobbins 5 in the same direction in the vibration systems 31 and 32 and by applying electric signals in phases reverse to each other to the voice coils 6, respectively.

Moreover, although in the above-described embodiment, the domed diaphragms 7 suitable for the high frequency sound reproduction are used in the vibration systems 31 and 32, the configuration of the diaphragm is not limited to this. Conical diaphragms 7 suitable for low frequency sound reproduction may be used in the vibration systems 31 and 32.

[Method for Fabricating Speaker Apparatus]

Figure 5:
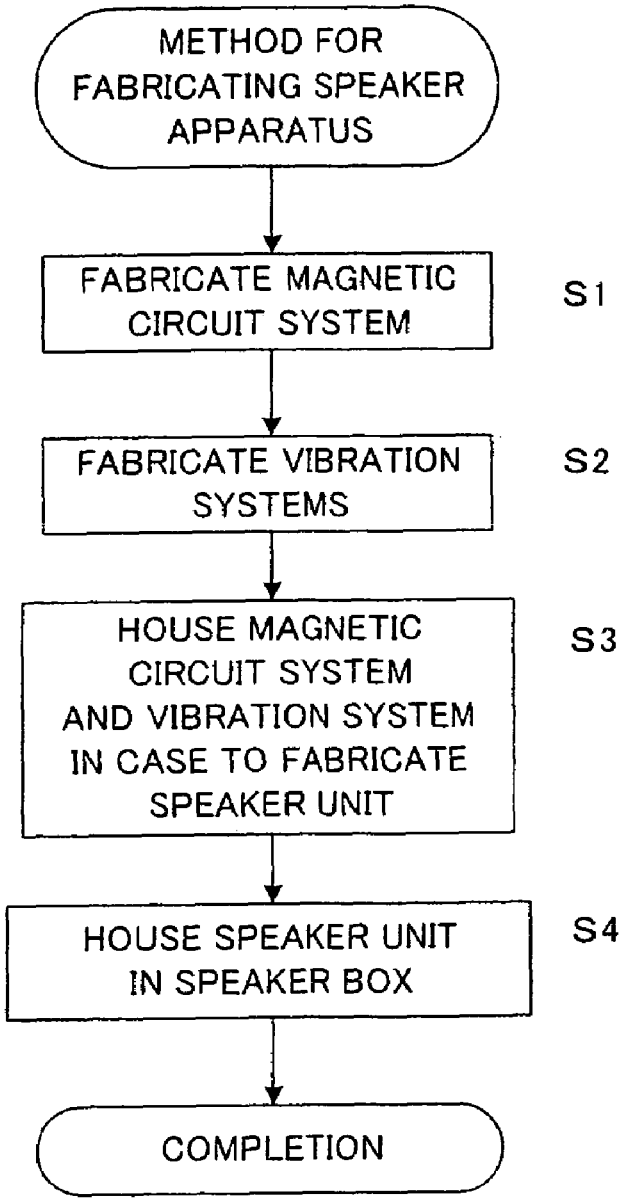
FIG. 5 is a flowchart illustrating a method for fabricating the speaker apparatus in the embodiment according to the invention.
Figure 6A:
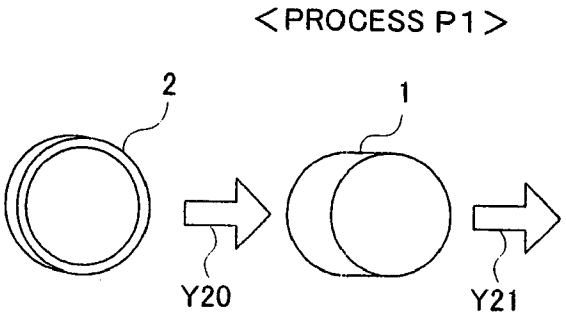
FIGS. 6A and 6B are perspective views showing process for fabricating a magnetic circuit system in the embodiment.
Figure 6B:
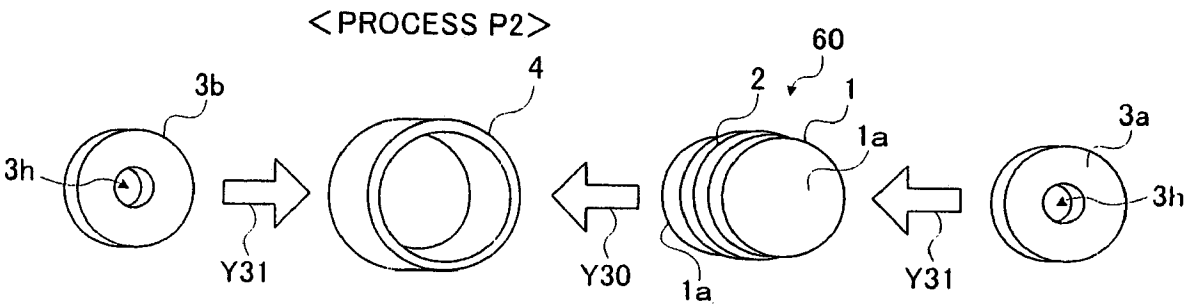
Figure 7B:
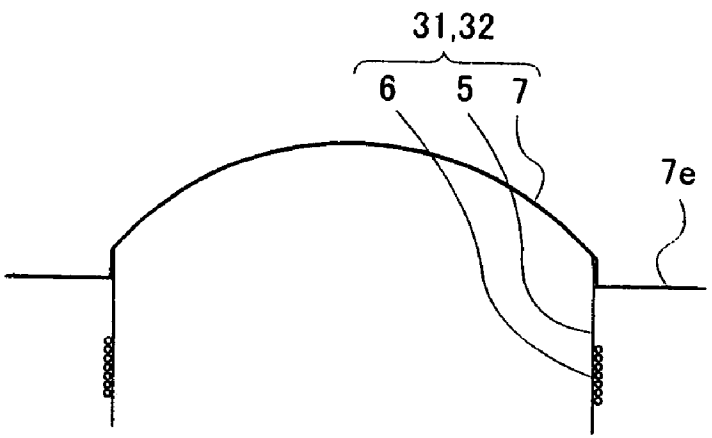
FIGS. 7A and 7B are cross-sectional views explaining a method for fabricating a vibration system in the embodiment.
Figure 7A:
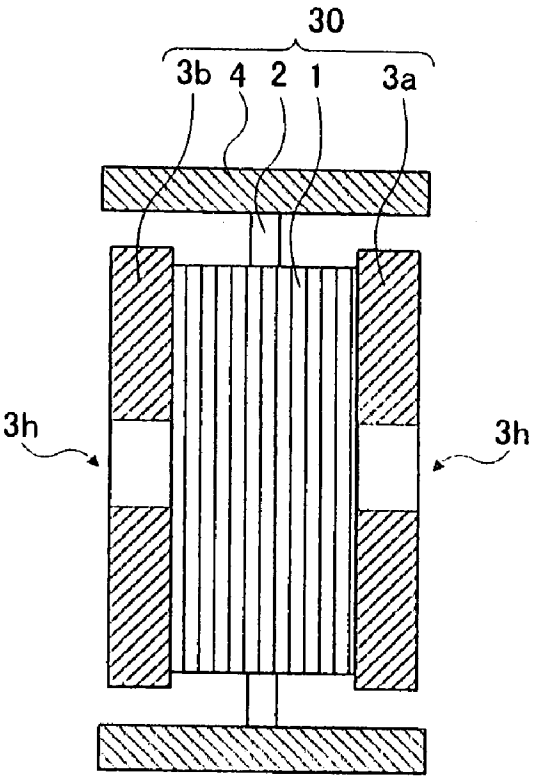
Figure 8:
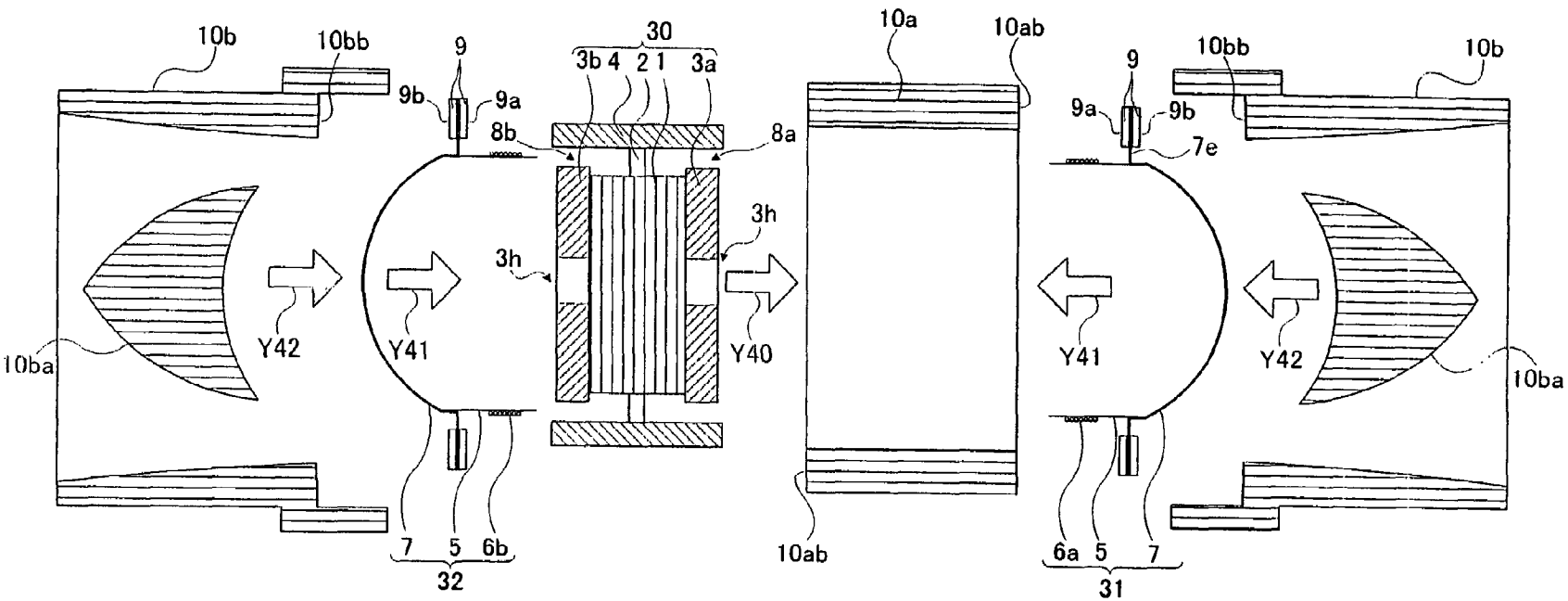
FIG. 8 is a cross-sectional view showing process for fabricating the speaker unit in the embodiment.

Next, a method for fabricating the speaker apparatus 100 will be explained with reference to FIGS. 5 to 8. FIG. 5 is a flowchart illustrating a method for fabricating the speaker apparatus 100. FIGS. 6A and 6B are perspective views showing processes for fabricating the magnetic circuit system 30. FIGS. 7A and 7B are cross-sectional views explaining a method for fabricating the vibration systems 31 and 32. FIG. 8 is a cross-sectional view showing processes for fabricating the speaker unit 50, wherein the magnetic circuit system 30 and the vibration systems 31 and 32' are housed inside the case 10.

First, the magnetic circuit system 30 is fabricated (step S1). Specifically, the magnetic circuit system 30 is fabricated through processes P1 and P2. As indicated by an arrow Y20 in FIG. 6A, the magnet holder 2 formed into substantially the annular shape is attached to the magnet 1 formed into substantially the disk-like shape. At this time, the magnet holder 2 is positioned substantially at the center position in a thickness direction of the magnet 1. In this manner, a magnet assembly 60, which is a semi-product, is fabricated, as indicated by an arrow Y21 in FIG. 6A.

Subsequently, as indicated by an arrow Y30 in FIG. 6B, the magnet assembly 60 is fitted into the yoke 4 formed into substantially the cylindrical shape, and further the plates 3*a* and 3*b*, each having the opening 3*h*, are fixed to the right and left surfaces 1*a* of the magnet 1 via adhesive elements, respectively, as indicated by arrows Y31. In this manner, the magnetic circuit system 30 is fabricated, as shown in the cross-sectional view in FIG. 7A.

Next, the vibration systems 31 and 32 are fabricated (step S2). Incidentally, since a method for fabricating the vibration systems 31 and 32 is not the characteristic feature of the invention, a detailed description will be omitted below. FIG. 7B shows a state after the vibration system 31 or 32 is assembled. The fabricating method will be simply described below with reference to FIG. 7B. First, the voice coil 6 is wound at a lower end on the outer peripheral wall of the voice coil bobbin 5 formed into substantially the cylindrical shape. Thereafter, the domed diaphragm 7 integrated with the edge 7*e* is attached to the voice coil bobbin 5. At this time, it should be noted that the voice coils 6 are wound around the voice coil bobbins 5 in the directions reverse to each other in the vibration system 31 and the vibration system 32. The reason is that the diaphragm 7 in the vibration system 31 and the diaphragm 7 in the vibration system 32 are vibrated in the opposite direction, thereby suppressing (or canceling) the vibrations generated in the magnetic circuit system 30 by the effect of the reaction, as described above. As a result, the vibration systems 31 and 32 having substantially the same configuration, as shown in FIG. 7B, are fabricated.

Then, the magnetic circuit system 30 and the vibration systems 31 and 32 are housed inside the case 10, and thus the speaker unit 50 is fabricated (step S3). Specifically, the speaker unit 50 is fabricated by fixing the constituent elements in accordance with the order of arrows Y40, 41 and 42 shown in FIG. 8. First, as indicated by the arrow Y40, the magnetic circuit system 30 is fitted into the first member 10*a* formed into substantially the cylindrical shape. Thereafter, the edge 7*e* of each of the vibration systems 31 and 32 is securely held by the pair of annular fixing members 9. Subsequently, as indicated by the arrows Y41, one circumferential end surface 9*a* of each of the fixing members 9 is fixed at a proper position at the circumferential end surface 10*ab* of the first member 10*a* via an adhesive element. Then, as indicated by the arrows Y42, the second member 10*b* is fixed to the first member 10*a* while the other circumferential end surface 9*b* of each of the fixing members 9 is brought into contact with one circumferential end surface 10*bb* of the second member 10*b*. In this manner, the speaker unit 50 shown in FIG. 2 is fabricated.

Next, the fabricated speaker unit 50 is housed at a proper position (at substantially the center position in the embodiment) inside the speaker box 51 shown in FIG. 1 (step S4). In this way, the speaker apparatus 100 shown in FIG. 1 is fabricated. In the above-described method for fabricating the speaker apparatus 100, a plurality of magnetic circuits need not be fabricated, thereby reducing the assembling cost by a cost required for fabricating a plurality of magnetic circuits.

The invention may be embodied on other specific forms without departing from the spirit or essential characteristics thereof. The present embodiments therefore to be considered in all respects as illustrative and not restrictive, the scope of the invention being indicated by the appended claims rather than by the foregoing description and all changes which come within the meaning an range of equivalency of the claims are therefore intended to embraced therein.

The entire disclosure of Japanese Patent Application No. 2004-212864 filed on Jul. 21, 2004 including the specification, claims, drawings and summary is incorporated herein by reference in its entirety.

What is claimed is:

1. A speaker unit comprising:

a magnetic circuit having a disk shaped magnet whose both surfaces are magnetized;

a pair of magnetic gaps formed at positions near both surfaces of the disk shaped magnet inside the magnetic circuit;

a pair of voice coils arranged in a manner corresponding to the pair of magnetic gaps, respectively; and a pair of diaphragms which are driven by the pair of voice coils, respectively, and which radiate acoustic waves in directions opposite to each other, wherein the magnetic circuit includes;

a pair of plates fixed to both surfaces of the disk-shaped magnet, respectively, a cylindrical yoke arranged, with a spacing equivalent to the magnetic gap, apart from a peripheral surface of each of the disk-shaped magnet and the pair of plates, and a magnet holder to be fixed to the peripheral surface of the disk-shaped magnet, wherein the cylindrical yoke is fixed to the disk-shaped magnet via the magnet holder.

2. A speaker unit according to claim 1, wherein the pair of voice coils have the same effective line length and are wound in directions relatively reverse to each other, and wherein the speaker unit further comprises a signal supplying circuit for supplying an equal electric signal to the pair of voice coils.

3. A speaker apparatus comprising:

a speaker box; and a speaker unit, wherein the speaker unit comprises:

a magnetic circuit having a disk shaped magnet whose both surfaces are magnetized;

a pair of magnetic gaps formed at positions near both surfaces of the disk shaped magnet inside the magnetic circuit;

a pair of voice coils arranged in a manner corresponding to the pair of magnetic gaps, respectively; and a pair of diaphragms which are driven by the pair of voice coils, respectively, and which radiate acoustic waves in directions opposite to each other, wherein the magnetic circuit includes:

a pair of plates fixed to both surfaces of the disk-shaped magnet, respectively, a cylindrical yoke arranged, with a spacing equivalent to the magnetic gap, apart from a peripheral surface of each of the disk-shaped magnet and the pair of plates, and a magnet holder to be fixed to the peripheral surface of the disk-shaped magnet, wherein the cylindrical yoke is fixed to the disk-shaped magnet via the magnet holder.

4. A method for fabricating a speaker unit comprising a process of fabricating a magnetic circuit, the process comprising the steps of:

attaching an annular magnet holder to a disk shaped magnet;

fitting the disk shaped magnet and the magnet holder into a cylindrical yoke;

attaching disk shaped plates to both surfaces of the disk shaped magnet; symmetrically fixing a pair of diaphragm units onto both sides of the magnetic circuit; and housing the magnetic circuit and the pair of diaphragm units inside of a case.

* * * * *